United States Patent [19]

Lynch et al.

[11] Patent Number: 4,975,625

[45] Date of Patent: Dec. 4, 1990

[54] ELECTRODELESS LAMP WHICH COUPLES TO SMALL BULB

[75] Inventors: Donald C. Lynch, Germantown; Mohammed Kamarehi, Rockville; James E. Simpson, Gaithersburg; Charles H. Wood, Rockville, all of Md.

[73] Assignee: Fusion Systems Corporation, Rockville, Md.

[21] Appl. No.: 211,543

[22] Filed: Jun. 24, 1988

[51] Int. Cl.[5] ..... H05B 41/24

[52] U.S. Cl. ..... 315/344; 315/39; 315/248

[58] Field of Search ..... 315/248, 39, 267, 344, 315/250, 111.21, 111.41, 326; 250/492.2

[56] References Cited

U.S. PATENT DOCUMENTS

| | | | |
|---|---|---|---|
| 4,485,332 | 11/1984 | Ury et al. | 315/112 |
| 4,532,427 | 7/1985 | Matthews et al. | 250/492.2 |
| 4,683,525 | 7/1987 | Camm | 362/346 |
| 4,749,915 | 6/1988 | Lynch et al. | 315/248 |
| 4,812,957 | 3/1989 | Hill | 362/263 |
| 4,859,906 | 8/1989 | Ury et al. | 315/248 |

*Primary Examiner*—Eugene R. LaRoche
*Assistant Examiner*—Ali Neyzari
*Attorney, Agent, or Firm*—Pollock, Vande Sande & Priddy

[57] ABSTRACT

An electrodeless lamp which couples strong microwave fields to a very small bulb of diameter about ½' or smaller. The lamp is operated in a mode which is independent of the height of the cavity and which provides electric field lines parallel to such height. The height of the cavity is substantially reduced as compared with prior lamps to provide strong coupling of the electric field to the bulb.

17 Claims, 5 Drawing Sheets

FIG. 2
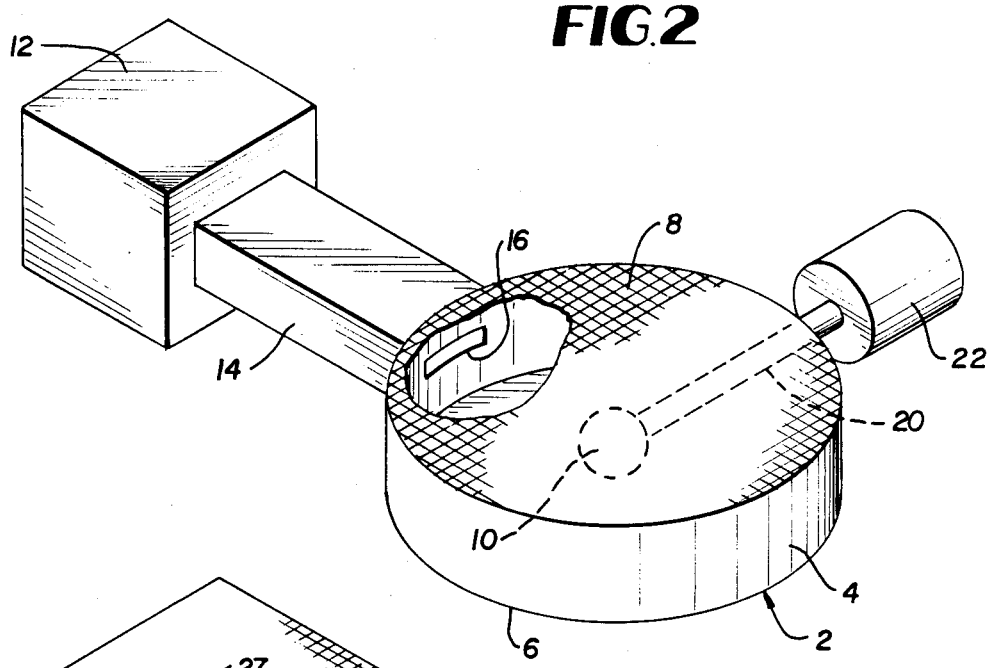
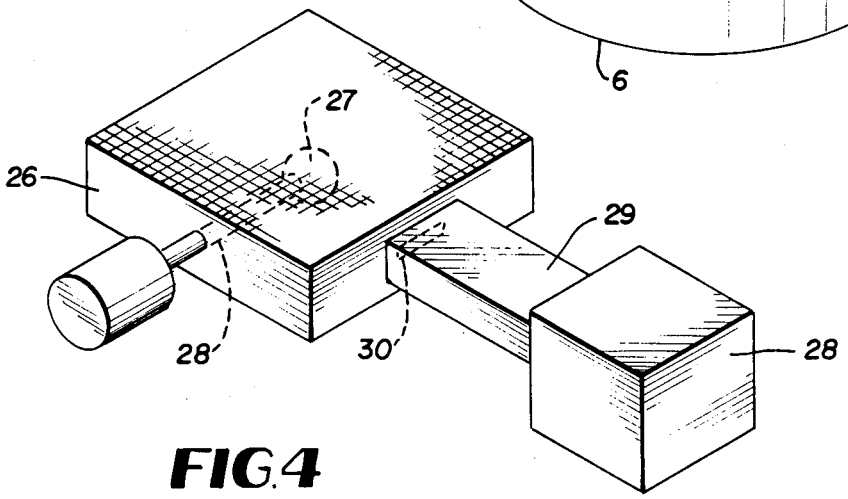
FIG. 4
FIG. 5
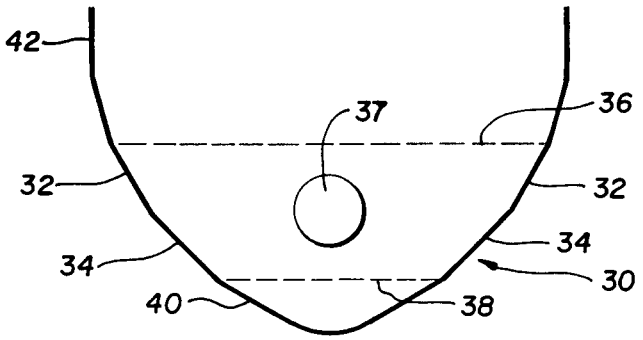

ELECTRODELESS LAMP WHICH COUPLES TO SMALL BULB

The present invention is directed to an improved electrodeless lamp for coupling high electric fields to a very small lamp bulb.

Electrodeless lamps are well known, and are frequently comprised of a microwave cavity in which a bulb containing a plasma forming medium is disposed. When microwave energy is fed to the cavity the bulb is ignited, and the light emitted therefrom exits the cavity through a mesh member which typically forms one surface of the cavity. For example, see U.S. Pat. Nos. 4,532,427, 4,485,332, and 4,683,525, as well as related pending Appl. No. 757,976, which disclose electrodeless lamps.

In the above-described type of electrodeless lamp, the bulb used typically has a diameter of ¾" or greater. When it is desired to use a smaller bulb, for example, of diameter ½" or smaller, it has been found that the cavities utilized in the prior art do not couple well, with the result that the radiation emitted by the bulb is not intense enough.

The reason for this is believed to be that ratio of the surface area to the volume of the bulb is related inversely to the diameter of the bulb. Thus, as the bulb becomes smaller, this ratio increases, with the result that as the plasma forming medium in the bulb is excited with microwave energy, there is more surface area per unit volume of the bulb to absorb energy from the excited gas. Thus, heat transfer to the bulb tends to increase with smaller bulbs, and a field which will produce a suitable level of radiation from a larger bulb will fail to produce a suitable level with a smaller bulb.

While electrodeless lamps utilizing coaxial transmission lines instead of microwave cavities have been proposed, and while these may couple to smaller bulbs, e.g., see U.S. Pat. Nos. 3,943,403 and 3,993,927, such lamps may be disadvantageous since by their nature they obscure part of the bulb output, and additionally may result in arcing.

It is thus an object of the present invention to provide an electrodeless lamp utilizing a microwave cavity which couples high microwave fields to a very small bulb of diameter ½" or smaller.

In accordance with the invention, the present inventors have recognized that if a microwave mode is selected which is independent of the height of the cavity and which has electric field lines parallel to such height, then in accordance with the relationship $C=A/d$ where C=capacitance A=plate area d=plate separation (cavity height), the height of a cavity of conventional dimension can be substantially reduced to provide a significant increase in the electric field in the region of the small bulb.

This results in a shorter lamp cavity than has heretofore been known, with the end result that higher levels of radiation are emitted by the small bulb than can be produced in the prior art.

The invention will be better understood by referring to the accompanying drawings, in which:

FIG. 2 is a schematic representation of an embodiment of the invention.

FIG. 4 is a schematic representation of a further embodiment of the invention.

FIG. 5 is a schematic representation of still a further embodiment of the invention.

As mentioned above, the present inventors recognized a mode is selected which provides electric field lines parallel to the height of the cavity, and if the existence of such mode is independent of cavity height, then the height of a cavity of conventional height can be substantially reduced to provide a much stronger electric field in the vicinity of the bulb.

Figure 1:
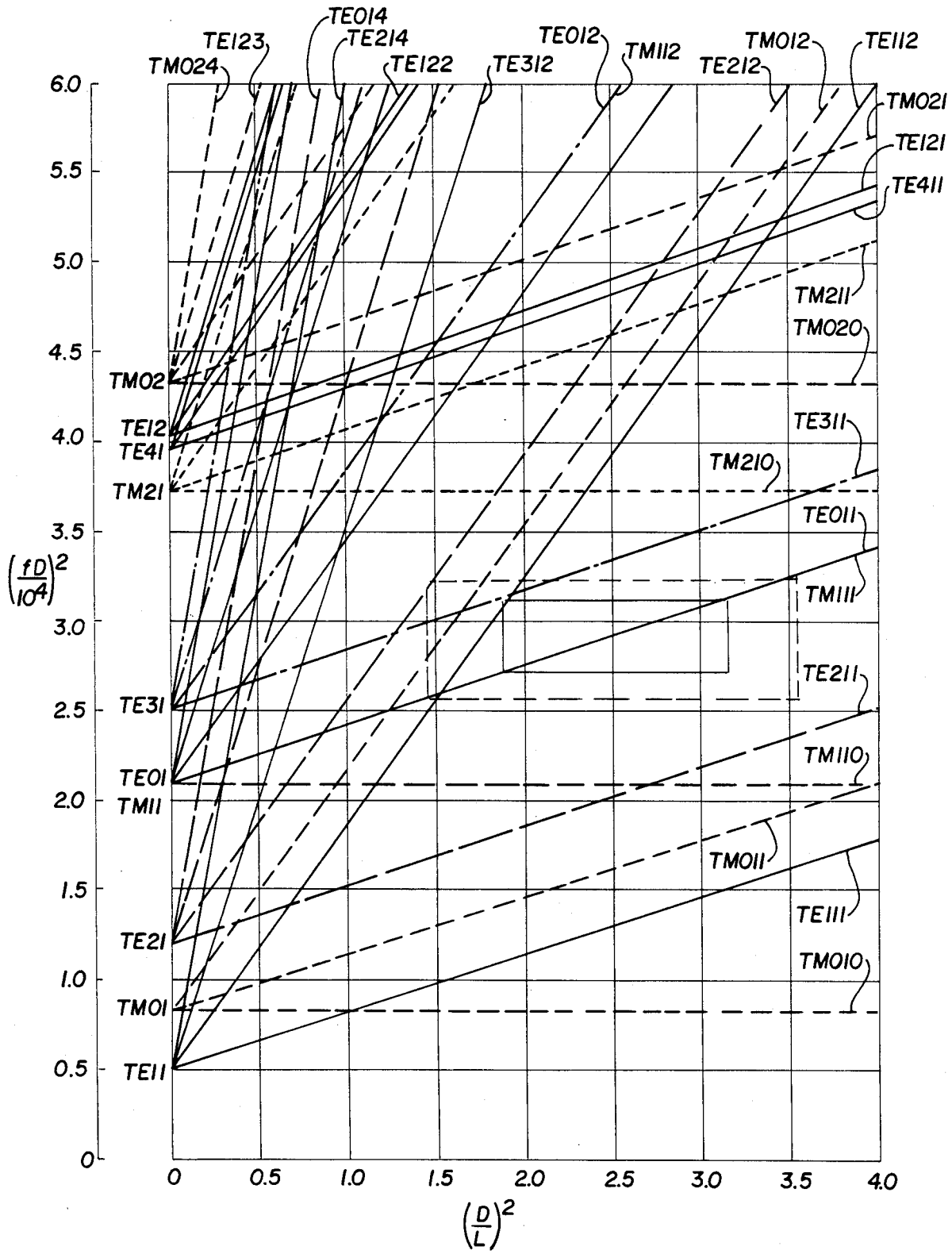
FIG. 1 is a mode chart for a right circular cylinder.

Referring to FIG. 1 which is a mode chart for a right circular cylindrical cavity, wherein D=Cavity Diameter L=Cavity Length (Height)

F=Frequency it is seen that the TM010 mode is independent of cavity height. Also, this mode results in electric field lines which are parallel to the cylindrical axis of the cavity.

Thus, in an embodiment of the invention, a right circular cylinder operating in the TM010 mode was utilized, and the height of the cavity was adjusted to maximize the field in the central region of the cavity.

This embodiment is depicted in FIG. 2, wherein cavity 2 is comprised of cylindrical wall 4 having ends 6 and 8 which may each be a mesh which is substantially transparent to the light emitted by the lamp while being substantially opaque to microwave energy. In the alternative, one of the ends may be comprised of solid metal, while the other may be a mesh.

Bulb 10 is of a diameter of about ½" or smaller, and is situated at about the diametric center of the cavity, although its location in height need not be exactly halfway up.

Magnetron 12 produces microwave energy, which in the illustrative embodiment is at 2450 Mhz. This is coupled by rectangular waveguide 14 to slot 16 in the sidewall of the cylindrical cavity.

The bulb 10 is supported by stem 20, which may be rotated by motor 22 to provide efficient cooling when the bulb is impinged with streams of compressed air (not shown) as it is rotated.

Figure 3:
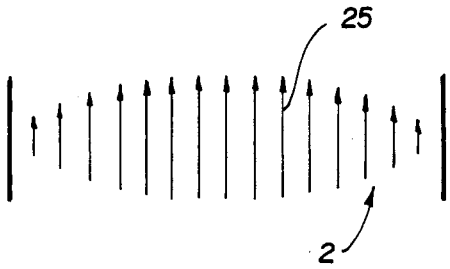
FIG. 3 is a depiction of the electric field lines in the embodiment of FIG. 2.

The electric field in cavity 2 is shown in FIG. 3. It is seen that this field is in the axial direction of the cavity, and is greatest at the cavity center. Further, the field increases as the height of the cavity is decreased until a maximum field for a bulb of given diameter is obtained.

The resultant lamp utilizes a cavity which of considerably shorter height than has heretofore been used. For example, in the state of the art cylindrical lamp, which couples to a ¾" diameter bulb, the cavity height is 2.6", while in the present lamp which couples to a ½" diameter bulb, the cavity height is only 1.06".

In a preferred embodiment of the invention, the inside bulb diameter was about 13 mm, the length of the cavity was 1.06", while its diameter was 3.4".

The principles of the invention may be applied to cavities of other shapes as well. For example, FIG. 4 shows a rectangular cavity of small height for coupling to a very small bulb, which is operated in the $TE_{10m}$ mode.

It is well known that after the lamp starts, it presents a different impedance to the cavity than before starting, and the operational mode will be somewhat affected thereby. Therefore, for the purpose of the present disclosure, recited modes are assumed to exist before lamp starting.

A still further embodiment of the invention is shown in FIG. 5. In this embodiment, cavity 30 is comprised of a sidewall which consists of one or more segments 32, 34, each of which is a conic selection, and each of which has an inside surface which is reflecting. The ends of the cavity are comprised of respective meshes 36 and 38, while behind the cavity, an exterior reflector 40 is disposed, which may also be comprised of segments. Similarly, an exterior reflector portion 42 may be disposed in front of the cavity, and this also may be segmented.

The effect of the reflecting cavity sidewall 32, 34, and the rear and front exterior reflectors 40 and 42 are to provide an entire reflector of desired shape to reflect the light emitted from bulb 37. While the reflector has been illustrated as being comprised of segments, it may instead comprise a more or less continuous surface.

Figure 6:
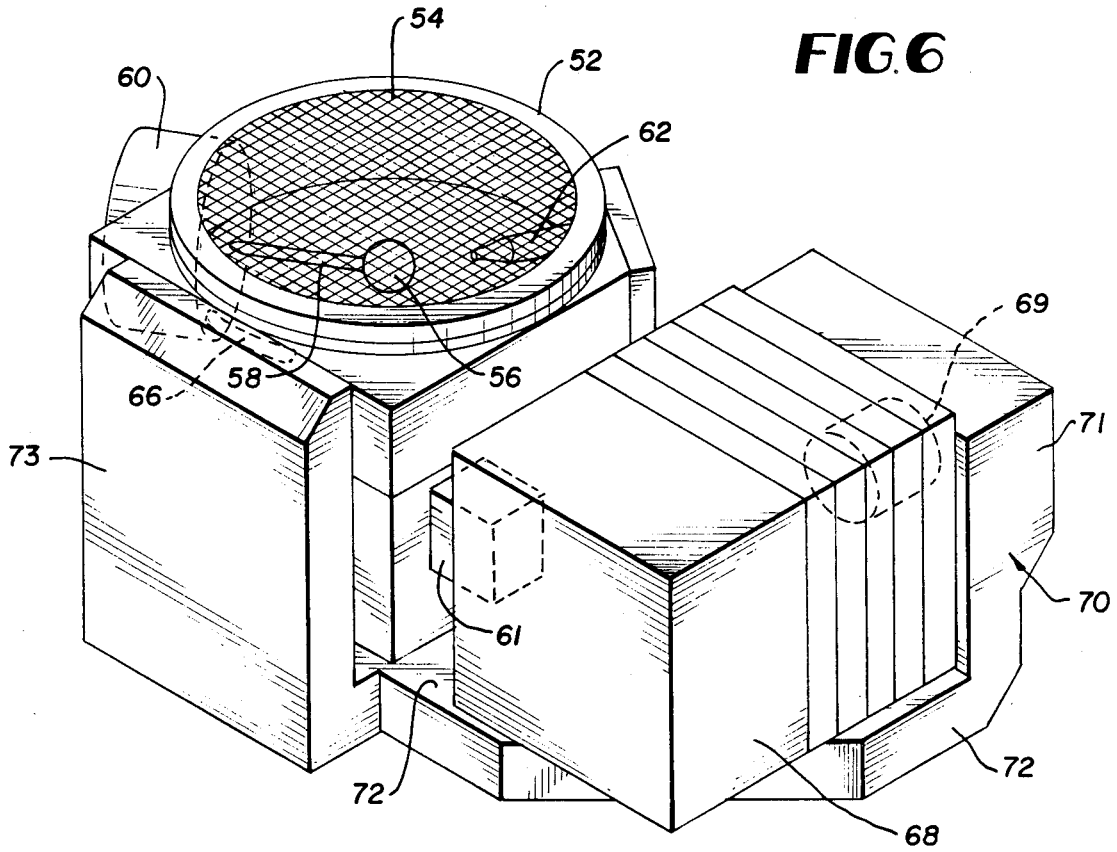
FIG. 6 is a pictorial representation of a preferred embodiment of the invention.
Figure 8:
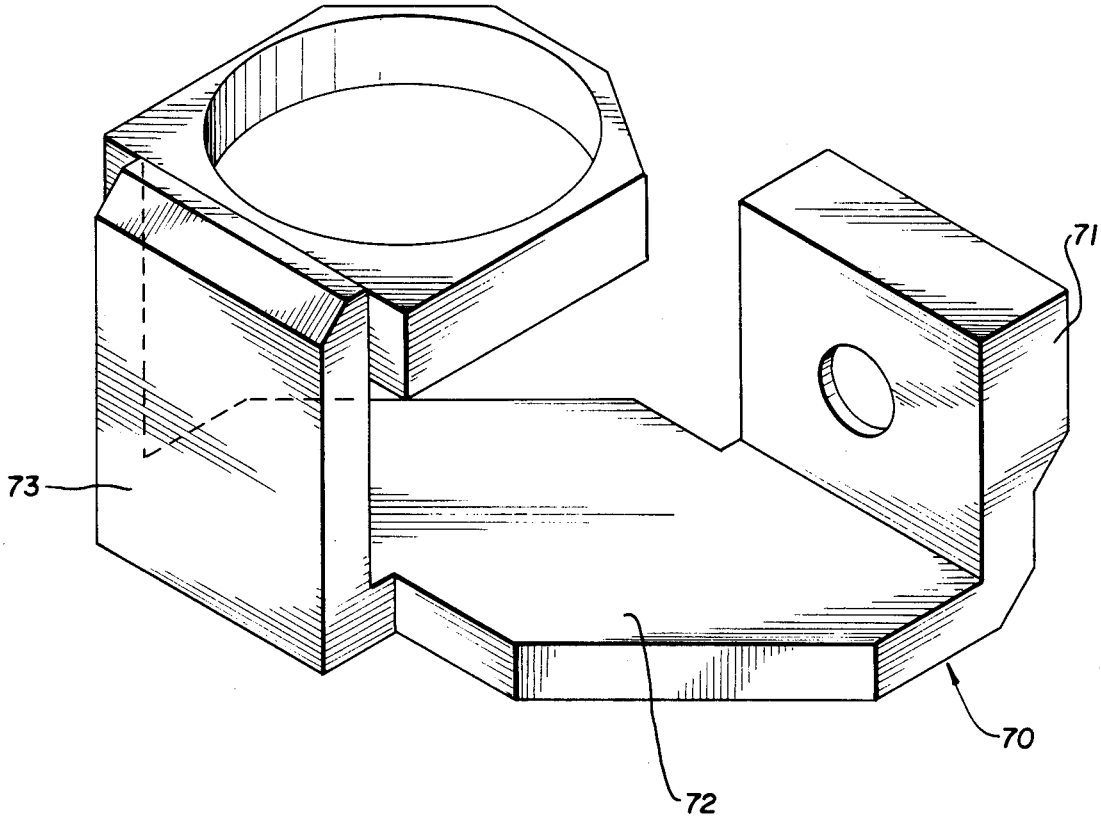
FIG. 8 is a detail of the waveguide used in the embodiment of FIG. 6.

A preferred embodiment of an electrodeless lamp in accordance with the invention is illustrated in FIG. 6. Referring to this Figure, bulb 56 is disposed in cylindrical cavity 52 having coupling slot 66 in the cylindrical sidewall. Magnetron 68 provides microwave power, which is coupled to the cavity by waveguide 70. The waveguide is bent around the magnetron as clearly depicted in FIG. 8, and is comprised of portions 71, 72, and 73, which are bent with respect to each other.

Figure 7:
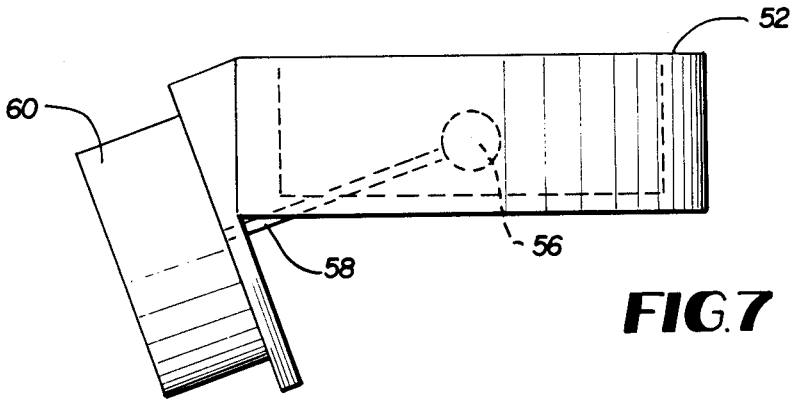
FIG. 7 is a detail of the embodiment of FIG. 6.

The bulb 56 is mounted by bulb stem 58, which is rotated by motor 60, while compressed air from jet 62 is impinged on the bulb, so as to cool it. As may be clearly seen in FIG. 7, the bulb stem is disposed at an angle (110°–130°) to the direction of the electric field to result in a more even temperature distribution across the bulb, as compared with the embodiment of FIG. 2, where the bulb stem is perpendicular to the direction of the electric field. Additionally, while only one cooling jet 62 is shown in FIG. 6, additional jets may be used, and in one embodiment, a second jet was located beneath jet 62 in FIG. 6.

Figure 9:
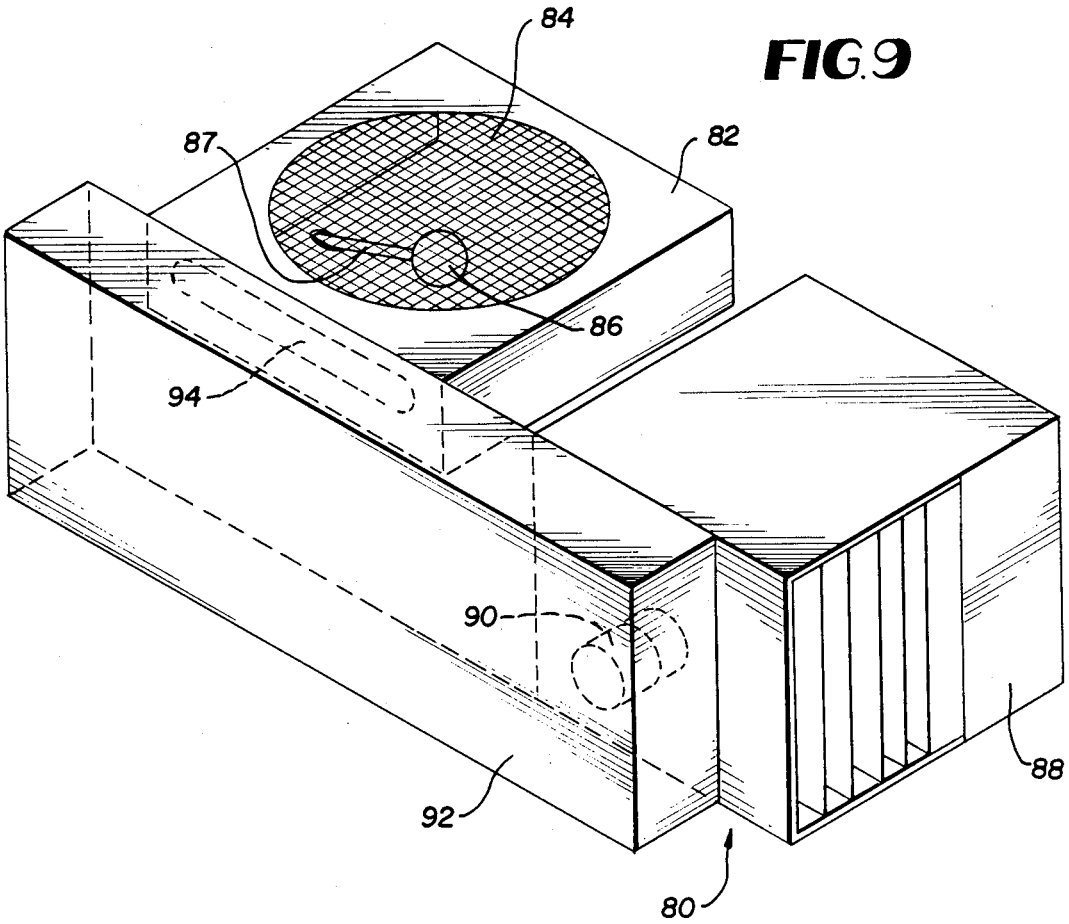
FIG. 9 is a pictorial representation of a further embodiment of the invention.

FIG. 9 depicts a further embodiment of the invention using a cavity of square cross-section. In this embodiment, energy from magnetron 88 is coupled by waveguide 92 via coupling slot 94 to cavity 82, while bulb stem 87 mounts bulb 86 for rotation at an angle of other than 90° to the electric field. This lamp is similar to the one shown in FIG. 4, and may be operated in the $TE_{101}$ mode.

There thus have been disclosed improved electrodeless lamps which make it possible to couple high electric fields to small lamp bulbs.

While the invention has been described in accordance with illustrative embodiments, it should be understood that variations will occur to those skilled in the art, and the scope of the invention is to be limited only by the claims appended hereto and equivalents.

We claim:

1. An electrodeless lamp which couples a high microwave field to a very small bulb of about ½" diameter or smaller, comprising, a microwave cavity having a cross-section of regular shape and a height dimension lying perpendicular to said cross-section, a very small bulb of about ½" diameter or smaller containing a plasma forming medium disposed in said cavity at a region near the center of said cavity cross-section, means for generating microwave energy of a preselected frequency, and waveguide means for coupling said microwave energy to said cavity, the dimensions of said cavity being such in relation to the frequency of said microwave energy that the lamp is operated in a pre-starting mode which is independent of the height of the microwave cavity and which includes electric field lines which are parallel to said height dimension of the cavity in said region near the center of said cavity cross-section, and wherein the height of the cavity is small enough to provide a strong microwave field in said region near the center of said cavity cross-section for coupling to said very small bulb of ½" diameter or smaller.

2. The electrodeless lamp of claim 1 wherein said cavity is in the shape of a right circular cylinder and the mode in which the lamp is operated is the $TM_{010}$ mode.

3. The electrodeless lamp of claim 1 wherein said cavity is in the shape of a rectangular parallelepiped, and the mode in which the lamp is operated is the $TE_{101}$ mode.

4. The electrodeless lamp of claim 3 wherein a cross-section of said rectangular parallelepiped is square.

5. The electrodeless lamp of claim 2 wherein said cavity has a coupling slot therein, which is disposed in the curved cylindrical wall of the cavity.

6. The electrodeless lamp of claim 5 wherein the long dimension of said coupling slot lies in the circumferential direction of said cavity wall.

7. The electrodeless lamp of claim 2 wherein the preselected microwave frequency is 2450 Mhz, the diameter of the bulb is about ½", the diameter of the cavity is about 3.4", and the height of the cavity is about 1.06".

8. The electrodeless lamp of claim 1 wherein the cavity is comprised of a cylindrical cavity wall of solid material and two cylinder ends lying in respective separated planes which are perpendicular to the height dimension of the cavity, wherein each end is made of mesh material which is substantially transparent to the light emitted by the bulb while being substantially opaque to microwave radiation.

9. The electrodeless lamp of claim 2 wherein the cylindrical cavity has respective ends which are comprised of mesh material which is substantially transparent to the light emitted by the bulb while being substantially opaque to microwave radiation.

10. The electrodeless lamp of claim 1 wherein said cavity is comprised of a sidewall and two ends and wherein the sidewall is in the shape of at least a conic section, and is made at least on the inside of the cavity of reflecting material.

11. The electrodeless lamp of claim 10 wherein said sidewall is in the shape of a plurality of connected conic sections, all of which are made at least on the inside of the cavity of reflecting material.

12. The electrodeless lamp of claim 10 wherein the ends are comprised of mesh material which is substantially transparent to light emitted by the lamp and substantially opaque to microwave radiation, and wherein there is a partial reflector extending from each cavity end.

13. The electrodeless lamp of claim 2 wherein said waveguide means is bent so as to wrap around said means for generating microwave energy.

14. The electrodeless lamp of claim 13 wherein said waveguide means includes three right angles.

15. The electrodeless lamp of claim 3 wherein said waveguide means comprises a straight rectangular waveguide having a slot therein in the long dimension of the waveguide to allow microwave energy to exit the waveguide and enter the cavity.

16. The electrodeless lamp of claim 2 wherein the bulb is mounted for rotation on a bulb stem which is disposed at an angle of other than 90° with respect to the direction of the electric field lines.

17. The electrodeless lamp of claim 14 wherein the bulb is mounted for rotation on a bulb stem which is disposed at an angle of other than 90° with respect to the direction of the electric field lines.

* * * * *